United States Patent [19]

Takano

[11] Patent Number: 5,028,156

[45] Date of Patent: Jul. 2, 1991

[54] SHEET HOLDING MECHANISM

[75] Inventor: Masatoshi Takano, Tokyo, Japan

[73] Assignee: Asahi Kogaku Kogyo Kabushiki Kaisha, Tokyo, Japan

[21] Appl. No.: 422,591

[22] Filed: Oct. 17, 1989

[30] Foreign Application Priority Data

Oct. 17, 1988 [JP] Japan ..... 63-135255[U]

[51] Int. Cl.[5] ..... B41J 13/10

[52] U.S. Cl. ..... 400/625; 400/603.1; 400/647.1; 271/292; 271/213

[58] Field of Search ..... 400/625, 599.1, 603.1, 400/647, 647.1; 271/292, 213, 207

[56] References Cited

U.S. PATENT DOCUMENTS

| | | | |
|---|---|---|---|
| 1,061,979 | 5/1913 | Burton | 271/213 |
| 1,875,917 | 9/1932 | Ens | 400/603.1 |
| 2,135,669 | 11/1938 | Kimmel et al. | 271/213 |
| 2,262,510 | 11/1941 | Morrison et al. | 271/213 |
| 4,502,805 | 3/1985 | Humbs | 271/292 |
| 4,655,446 | 4/1987 | Heindke et al. | 271/207 |
| 4,813,800 | 3/1989 | Hasegawa et al. | 400/606 |

FOREIGN PATENT DOCUMENTS

| | | | |
|---|---|---|---|
| 23633 | of 1901 | United Kingdom | 271/213 |

*Primary Examiner*—Edgar S. Burr
*Assistant Examiner*—John S. Hilten
*Attorney, Agent, or Firm*—Sandler, Greenblum & Bernstein

[57] ABSTRACT

A sheet holding mechanism for receiving and stacking sheets such as recording papers ejected from a main apparatus such as, for instance, a printer. The mechanism comprises an ejected sheet tray provided to the main apparatus that is swingable in a predetermined range. The tray is lockable by lock means at every predetermined angle in the above predetermined range. Guide roller means provided to the main apparatus lead the sheet ejected from the main apparatus to the tray and is arranged to be swingable in response to swing movement of the tray.

3 Claims, 5 Drawing Sheets

SHEET HOLDING MECHANISM

BACKGROUND OF THE INVENTION

The present invention relates to a sheet holding mechanism of an apparatus, such as a copying machine, a printer or the like, for transferring data onto a recording sheet.

Heretofore, copying machines, printers and the like have been known for transferring data onto recording sheet.

Such an apparatus is arranged so that a recording sheet introduced from a recording-sheet introducing port into the apparatus is subjected to a predetermined processing, such as copying, printing and the like before being ejected from a sheet eject port.

An ejection sheet tray is normally attached to one side where the sheet eject port of the apparatus is located and sheets of recording sheet ejected from the sheet exhaust port are placed and stacked on the sheet tray.

However, the sheet tray has to be larger in size than the maximum size of the recording sheet that the apparatus can deal with. Accordingly, the apparatus needs a wide space for installation only because of the sheet tray, despite the fact that the tendency is for the apparatus to be made compact.

In view of the installation space and operability, it is needless to say advantageous if the angle of the sheet tray is freely adjustable. Notwithstanding, difference in angle between the sheet eject from the sheet eject port and the sheet tray may cause sheet-jamming. The problem is that the sheet cannot be ejected onto the sheet tray smoothly.

SUMMARY OF THE INVENTION

It is therefore an object of the invention to provide a sheet holding mechanism capable of ejecting sheets onto an ejected sheet tray without causing sheet-jamming even though the angle of the sheet tray is altered, so that this arrangement may contribute to not only saving installation space but also resulting in the improved operation of the apparatus.

In order to accomplish the foregoing object according to the present invention, a sheet holding mechanism stacking sheets ejected from a main apparatus, comprises an ejected sheet tray that is swingably pivoted to the main apparatus at one end which is formed as a ratchet wheel; a pawl member swingably pivoted to the main apparatus and biased in the direction to mesh with the ratchet wheel of the ejected sheet tray; and a roller supporting member swingably pivoted to the main apparatus for supporting guide rollers which lead the sheet outputted from the main apparatus to the ejected sheet tray, the roller supporting member being biased to upwardly swing and being swung downwardly in response to downward swing movement of the ejected sheet tray.

DESCRIPTION OF THE ACCOMPANYING DRAWINGS

DESCRIPTION OF THE EMBODIMENTS

Figure 1:
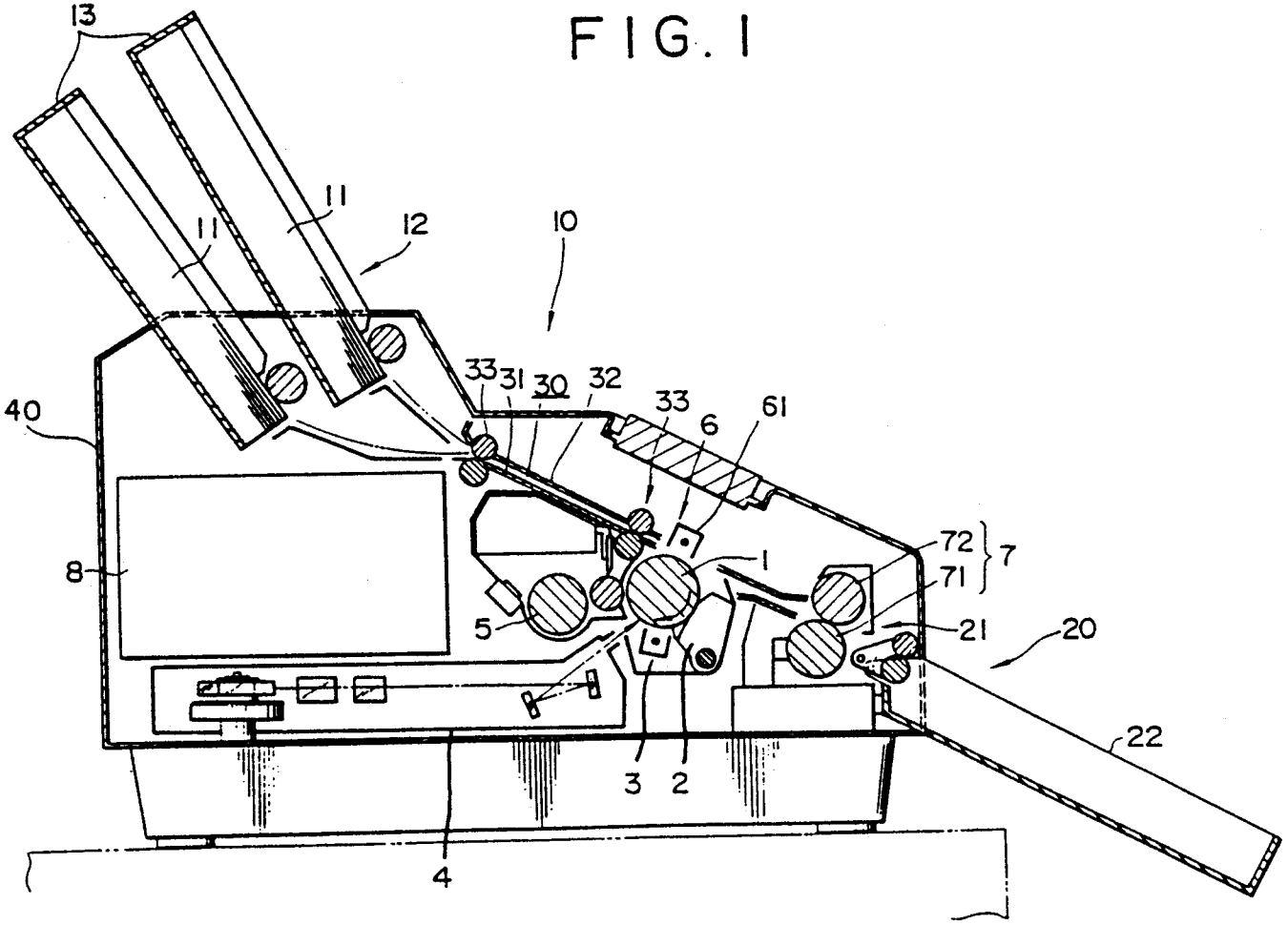
FIG. 1 is a schematic side view illustrating a laser beam printer to which a paper exhaust unit embodying the present invention is applied.

FIG. 1 is a schematic side view illustrating a laser beam printer to which a paper eject unit embodying the present invention is applied, this printer being a so-called page printer in which cutsheets cut into predetermined sizes are used.

The laser beam printer 10 shown in FIG. 1 looks like a rectangular parallelepiped with its top diagonally cut at a predetermined angle.

The uppermost section of body 40 forms a cassette holding portion 12 to receive a pair of paper cassettes 13, 13 in which papers of different sizes to each other are stored, respectively. During the execution of a printing operation, the recording papers are sequentially introduced one by one into a paper feed path 30. An ejected paper tray 22 is provided to the side of the body 40 opposite in the diagonal direction to a cassette holding portion 12.

A pair of opposed feed rollers 33, 33 are respectively provided to the cover plates 31, 32 one of which is driven to rotate by a drive means, not shown.

A photoconductive drum 1 is disposed under the substantially central area of the paper feed path 30 in the body 40.

Around the photoconductive drum 1 in the body 40, the following units are disposed along the direction of its rotation in the order described below: a cleaning unit 2 for removing toner remaining on the surface of the drum 1, a charging unit 3 for uniformly charging the surface of the drum 1, an laser scanning unit 4 for scanning the charged surface of the drum 1 with laser beams carrying image data to form a latent image thereon, and a developing unit 5 for putting toner onto the portion of the surface of the drum 1 exposed to the laser beams to develop a toner image. A reference numeral 8 represents a control unit for controlling the operation of the printer 10, including a power source.

Corona charger 61 charges the recording paper 11 so that the toner image on the drum 1 transferred thereonto is disposed opposedly to the drum 1 with the paper feed path 30 therebetween. The corona charger 61 and the portion of the drum 1 opposed thereto constitute a transfer unit 6.

A fixing unit 7 is arranged downward stream of the transfer unit 7 along the paper feed path 30. The fixing unit 7 comprises a heat roller 71 and a backup roller 72 opposedly disposed with defining the paper feed path 30 therebetween. The recording paper 11 carrying the unfixed toner image is nipped between the rollers 71, 72 and the toner is fixed onto the recording paper 11 by heat and pressure applied by the heat roller 71. A drive motor, not shown, is employed to rotate the heat roller 71 to feed the recording paper 11 in the fixing unit 7.

The laser beam printer thus constructed operates as follows:

The recording papers 11 stored in any one of the paper cassettes 13 fitted to the cassette holding portion 12 of the body 40 are drawn out thereof one by one into the paper feed path 30. The recording paper 11 thus introduced into the paper feed path 30 is fed by the feed rollers 33, 33. The toner image formed on the surface of the photoconductive drum 1 is transferred to the undersurface of the recording paper 11 at the transfer unit 6. The toner image transferred onto the undersurface of the recording paper 11 is fixed by the fixing unit 7, and the recording paper 11 is then ejected onto an ejection paper tray 22 with its image-carrying side down (i.e. in facedown state).

A paper eject unit 20 embodying the present invention is disposed ahead of the recording paper feed path (i.e. the paper exhaust path).

Figure 2:
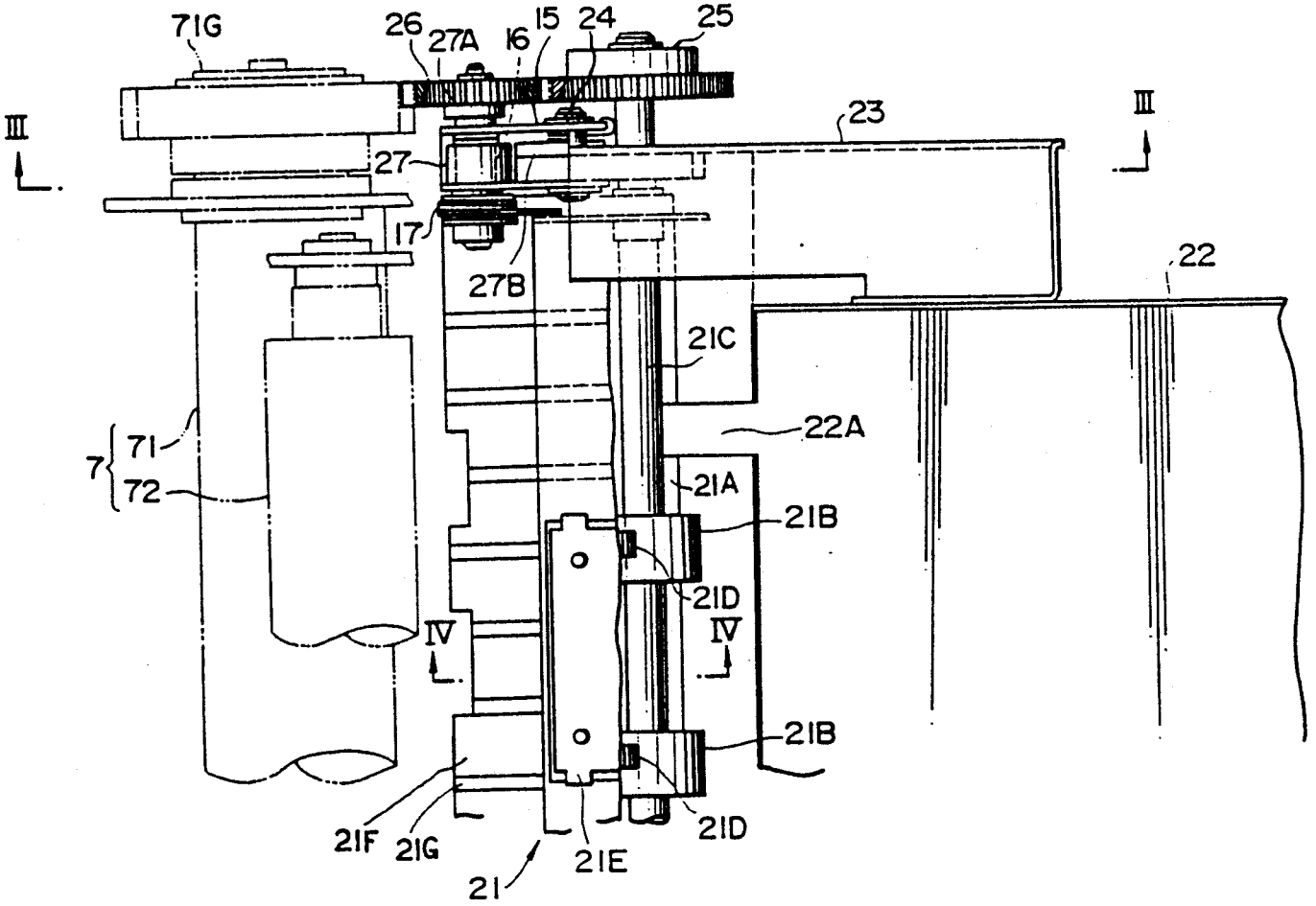
FIG. 2 is a partial enlarged elevational view of the paper exhaust unit.
Figure 3:
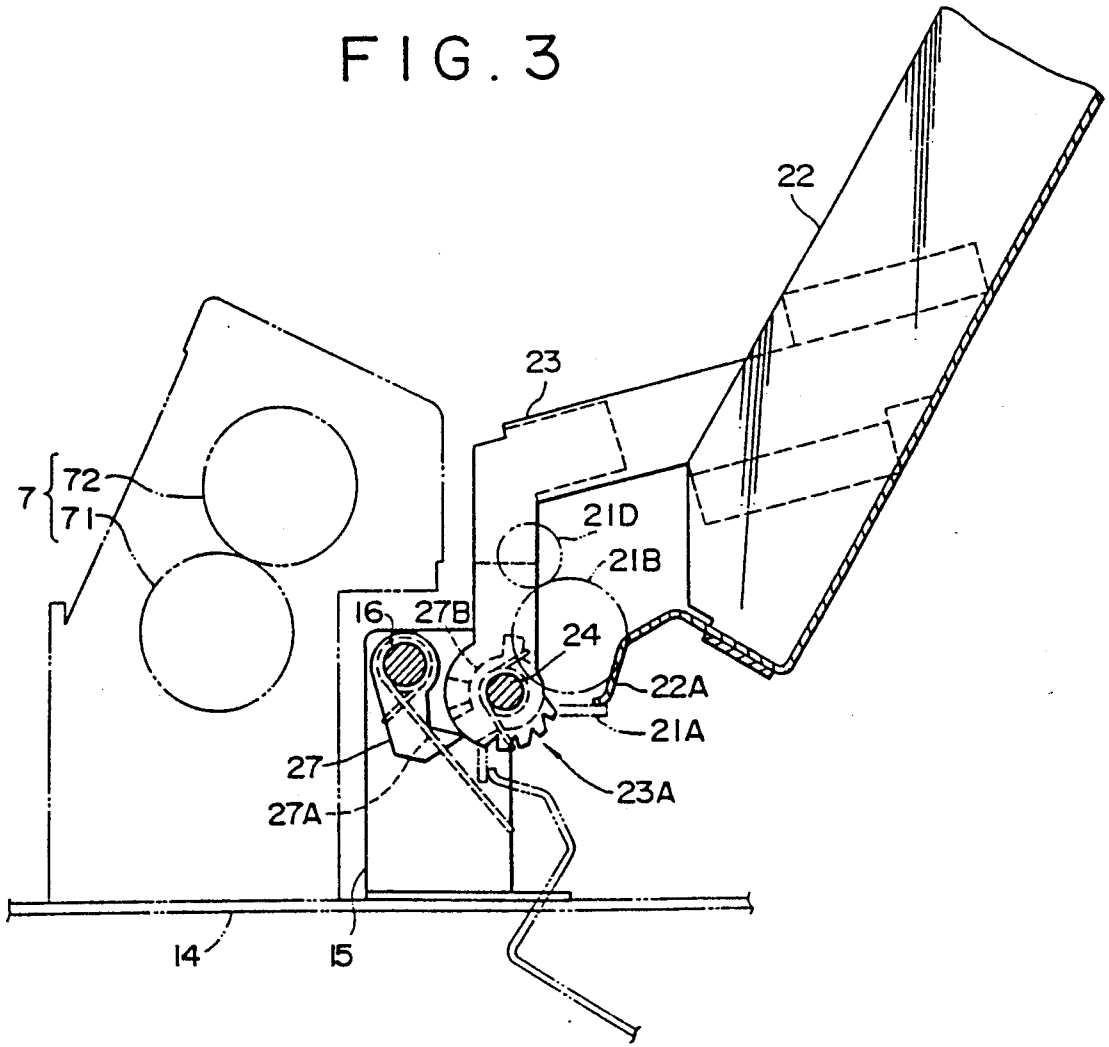
FIG. 3 is a sectional view taken on line III—III of FIG. 2.
Figure 4:
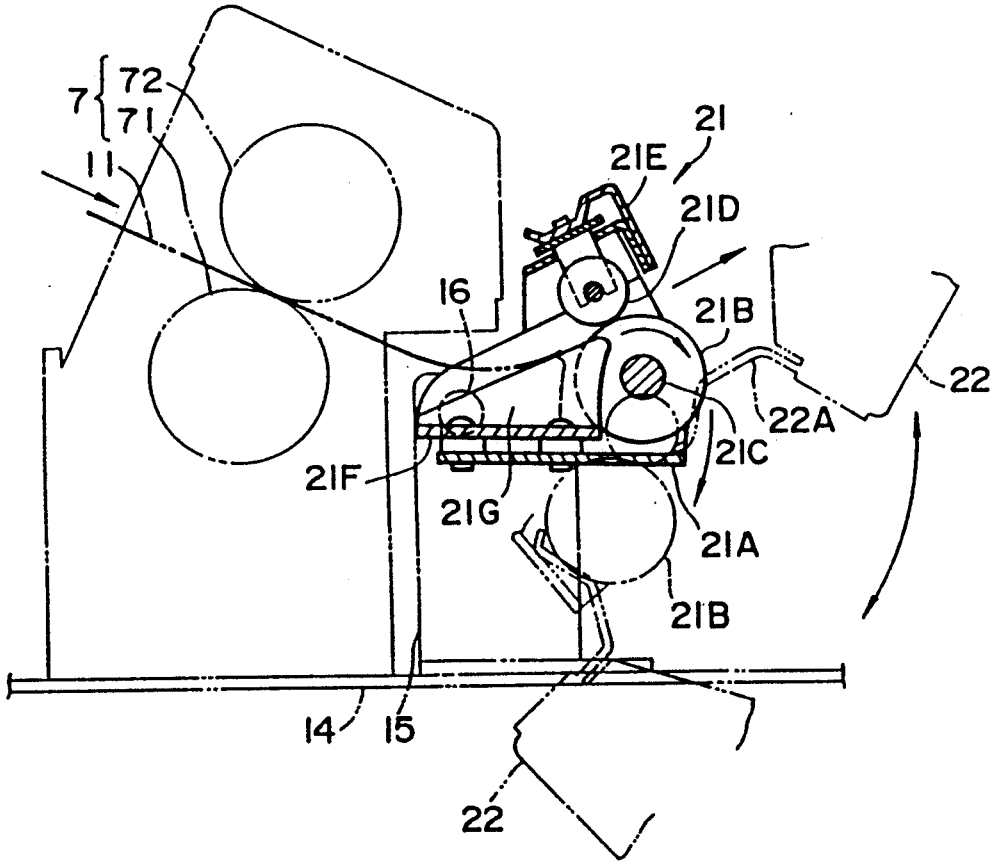
FIG. 4 is a sectional view taken on line IV—IV of FIG. 2.
Figure 5:
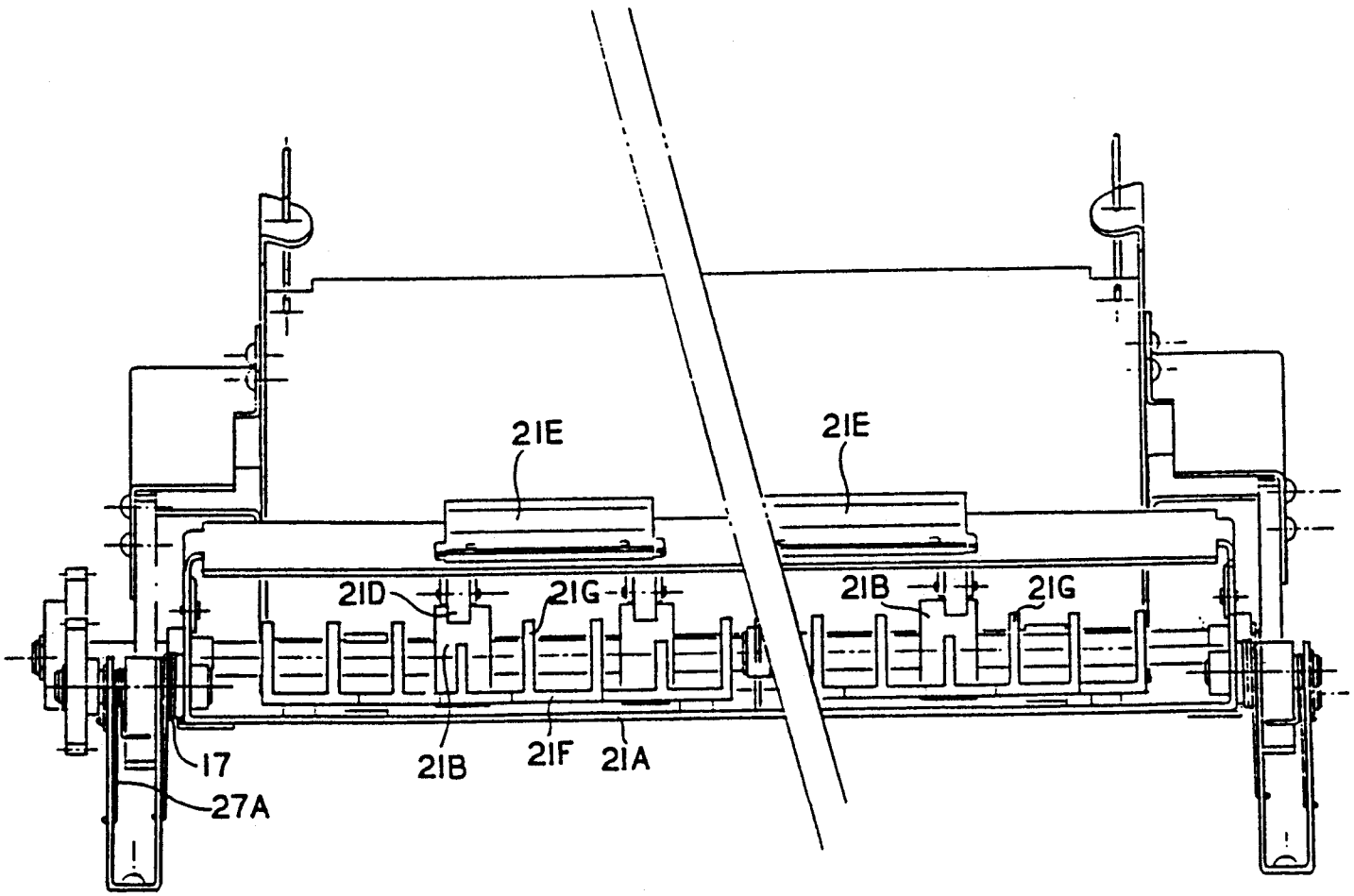
FIG. 5 is a left-hand side view of FIG. 2.

The paper exhaust unit 20, as shown in a partial enlarged elevational view in FIG. 2, in a sectional view taken on line III—III of FIG. 2 in FIG. 3, and in a sectional view taken on line IV—IV of FIG. 2 in FIG. 4 and in a left-hand side view of FIG. 2 in FIG. 5 comprises a pair of eject paper driving rollers 21 and an ejected paper tray 22, the pair of the rollers and the tray being fitted to a frame 14 of the printer in such a manner that they are independent of each other.

The pair of eject paper driving rollers 21 are arranged so that a roller shaft 21C with a drive roll 21B fixed at a predetermined position is rotatably fitted to a roller base 21A having both ends projected perpendicularly to the lateral direction of the printer and that a press roll 21D is biased by leaf springs 21E which is L-shaped in section and press-fitted to the upper side of the drive roll 21B. Moreover, the surface of the roller base 21A is fitted with a guide member 21F having its upper end face as a diagonal plane extended toward the contact between the drive roll 21B and the press roll 21D and having a plurality of triangular ribs 21G.

The roller base 21A has both ends coupled to brackets 15 perpendicularly fixed to the frame 14 via pins 16 and always biased by springs 17 wound on the respective pins 16 so as to rock upwardly. Gears 25 fixed to the respective ends of the roll shaft 21C engage with gears 71G for driving the heat roll 71 of the fixing unit 7 to rotate via gears 26 fixed to the pins 16. The roll shaft 21C (i.e. the drive roll 21B) is thus driven to rotate synchronously with the rotation of the heat roller 71.

The paper tray 22 is fitted to the brackets 15 perpendicularly fixed to the frame 14 via arms 23 fixed to both sides of the paper tray 22 by means of respective pins 24 and capable of rocking. In other words, the paper tray 22 is fixed to the brackets 15 (frame 14) in such a manner that it is capable of rocking about the pins 24.

A plurality of ratchet teeth 23A are formed around each pin 24 at the front end of the arm 23 and a ratchet pawl 27 engages with the ratchet tooth 23A, the ratchet pawl being rotatably mated with the pin 16 fitted to the roller base **21*a* and so biased by a spring 27A so as to be capable of rocking in the direction of the ratchet teeth 23A. The paper tray 22 capable of rocking about the pins 24 is locked at a given angle at which the ratchet teeth 23A engage with the ratchet pawls 27. Release members 27B are used to release the ratchet pawls 27 from engaging with the respective ratchet teeth 23A when the paper tray 22 is rocked upward by over a predetermined angle. A continuous line of FIG. 3** illustrates a released state.

An operating lever 22A for driving the pair of eject paper drive rollers 21 projects from the front end of the paper tray 22. When the rear end surface of the roller base 21A of the pair of the eject paper drive rollers 21 rocking upwardly abuts against the operating lever 22A, the upward rocking of the pair of the eject paper drive rollers 21 is restricted thereby.

The rocking of the pair of eject paper drive rollers 21 is accordingly interlocked with that of the paper tray 22. In proportion to the set rocking angle of the paper tray 22, the pair of eject paper drive rollers 21 are arranged so that their set angle allows the recording paper from the fixing unit 7 to be guided in between the pair of eject paper drive rollers 21 and the recording paper being fed by the pair of eject paper drive rollers 21 to be guided onto the paper tray 22.

With this arrangement, the recording paper 11 subjected to fixation and fed from the fixing unit 7 has it front end abut against the ribs 21G of the guide member 21F of the pair of eject paper drive rollers 21. Before being ejected onto the paper tray 22, the recording paper 11 is guided in between the drive roll 21B and the press roll 21D and driven to be fed as the drive roll 21B rotates. If the set angle of the paper tray 22 is adjusted to downwardly rock, as shown by an imaginary line in FIGS. 3 and 4, the paper eject drive roller 21 is caused to rock downward as the paper tray 22 rocks and the recording paper can be driven to be ejected from the fixing unit 7 onto the paper tray 22.

The paper eject unit according to the present invention is designed so that the angle of the paper tray is made adjustable in that the pair of rollers for driving the recording paper to be guided onto the paper tray, whereby the recording paper can be ejected onto the paper tray without trouble such as paper-jamming caused by altering the set angle thereof.

As a result, the angle of the paper tray becomes adjustable over a wide range with the effect of allowing such a printer to be installed in a space so small as to be unfit for a regular printer, whereas the operability of the printer is also improved.

What is claimed is:

1. A sheet holding mechanism for receiving and stacking sheets ejected from a main apparatus, comprising:

an ejected sheet tray that is swingably pivoted to said main apparatus, one end of said ejected sheet tray forming a ratchet wheel;

a pawl member that is swingably pivoted to said main apparatus and which is biased in a direction to mesh with said ratchet wheel of said ejected sheet tray; and a roller supporting member that is swingably pivoted to said main apparatus for supporting guide rollers which lead a sheet that is outputted from said main apparatus to said ejected sheet tray, said roller supporting member being biased to swing upward with an upward positioning of said ejected sheet tray, while being swung downward in response to a downward positioning of said ejected sheet tray so that an angle between a sheet feed path of said main apparatus and said ejected sheet tray is changed based upon the swinging movement of said ejected sheet tray so that a sheet can be guided onto said ejected sheet tray.

2. The sheet holding mechanism according to claim 1, wherein said ejected sheet tray is provided with a contact member which contacts said roller supporting member in such a fashion that said contact member downwardly pushes said roller supporting member against a biasing force when said ejected sheet tray is downwardly swung.

3. The sheet holding mechanism according to claim 1, wherein said roller supporting member is provided with a plurality of guide ribs, upper surfaces of said guide ribs being extended to guide said sheet ejected from said main apparatus toward a nip between said guide rollers.

* * * * *